US007453682B2

(12) United States Patent
Kim et al.

(10) Patent No.: US 7,453,682 B2
(45) Date of Patent: Nov. 18, 2008

(54) DISCHARGE DEVICE AND AIR CONDITIONER HAVING SAID DEVICE

(75) Inventors: Ho Jung Kim, Inchun-si (KR); In Ho Choi, Kyungki-do (KR); Kwan Ho Yum, Seoul (KR); Ho Seon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/319,463

(22) Filed: Dec. 29, 2005

(65) Prior Publication Data

US 2006/0227493 A1 Oct. 12, 2006

(30) Foreign Application Priority Data

Apr. 11, 2005 (KR) ..... 10-2005-0030002

(51) Int. Cl.
*H01T 23/00* (2006.01)
*H05F 3/00* (2006.01)

(52) U.S. Cl. ..... 361/231; 361/230; 361/232; 361/233

(58) Field of Classification Search ..... 361/231–233
See application file for complete search history.

(56) References Cited

U.S. PATENT DOCUMENTS 5,493,175 A * 2/1996 Kani ..... 313/584
7,294,176 B2 * 11/2007 Kim et al. ..... 96/69
2006/0227486 A1 * 10/2006 Kim et al. ..... 361/120

FOREIGN PATENT DOCUMENTS

JP 8-240968 A 9/1996
JP 2004-192993 A 7/2004
KR 1020010085249 A 8/2004

* cited by examiner

*Primary Examiner*—Stephen W Jackson
*Assistant Examiner*—Dharti H Patel
(74) *Attorney, Agent, or Firm*—Birch, Stewart, Kolasch & Birch, LLP

(57) ABSTRACT

A surface discharge type air cleaning device comprises an insulating dielectric body formed in the shape of a sheet, a discharge electrode having a pattern part of a predetermined area formed on the upper surface of the insulating dielectric body and at least one non-pattern part disposed in the pattern part and a ground electrode formed at the lower surface of the insulating dielectric body. The discharge electrode and the ground electrode have a plurality of pointed ends protruded therefrom, respectively. The pointed ends of the discharge electrode and the pointed ends of the ground electrode are disposed at the upper and lower surfaces of the insulating dielectric body, respectively, such that the pointed ends of the discharge electrode and the pointed ends of the ground electrode correspond to each other. Generation of negative ions and hydroxyl radicals is increased while generation of ozone is decreased, and therefore, air cleaning efficiency is improved.

22 Claims, 6 Drawing Sheets

DISCHARGE DEVICE AND AIR CONDITIONER HAVING SAID DEVICE

BACKGROUND OF THE INVENTION

1. Field of the Invention

The present invention relates to a discharge device used as a sterilizer module for air purification, and, more particularly, to a surface discharge type air cleaning device that is capable of increasing generation of hydroxyl (OH) radicals while decreasing generation of ozone, which is toxic to humans, thereby increasing discharge safety and improving noxious gas sterilizing efficiency and air cleaning efficiency.

2. Description of the Related Art

Generally, a surface discharge type air cleaning device adopts a surface discharge plasma chemical processing method. Specifically, the surface discharge type air cleaning device is a ceramic-based high frequency discharge type air cleaning device that is capable of generating a large number of hydroxyl radicals and a large amount of ozone through the formation of a strong plasma area on the surface of an element and processing noxious gases through the use of the generated hydroxyl radicals and ozone.

FIG. 1 is a plan view showing a conventional surface discharge type air cleaning device, and FIG. 2 is a cross-sectional view of the conventional surface discharge type air cleaning device seen from line A-A of FIG. 1.

As shown in FIGS. 1 and 2, the conventional surface discharge type air cleaning device comprises: an insulating dielectric body 10, which is composed of two rectangular sheets attached to each other while being disposed in surface contact with each other; a discharge electrode 12 disposed on the upper surface of the insulating dielectric body 10; and a ground electrode 14 disposed between the two rectangular sheets of the insulating dielectric body 10. On the upper surface of the insulating dielectric body 10 is applied a coating layer 16 for covering the discharge electrode 12 such that the discharge electrode 12 is not directly exposed to the atmosphere.

Generally, the insulating dielectric body 10 is made of a ceramic material. The discharge electrode 12 is connected to one terminal of a power source supply unit, and the ground electrode 14 is connected to the other terminal of the power source supply unit, such that the power source is supplied to not only the discharge electrode 12 but also the ground electrode 14. An alternating current power source is used as the power source.

The discharge electrode 12 comprises: three main electrodes 12*a*, which are arranged in parallel with one another; and subsidiary electrodes 12*b* protruding from the main electrodes 12*a*, each of the subsidiary electrodes 12*b* having a pointed end. The ground electrode 14 comprises: two branched ground electrodes 14*a*, which are arranged in parallel with each other and disposed opposite to the subsidiary electrodes 12*b*.

When a power source having a voltage higher than onset voltage is applied to the discharge electrode 12 and the ground electrode 14 of the conventional surface discharge type air cleaning device with the above-stated construction, a dielectric breakdown phenomenon occurs between the discharge electrode 12 and the ground electrode 14. As a result, a discharge phenomenon occurs on the surface of the insulating dielectric body 10, as shown in FIG. 3, and therefore, a strong plasma area is formed on the surface of the insulating dielectric body 10.

When the plasma is discharged as described above, a conductive path, which is called a streamer, is formed on the surface of the insulating dielectric body 10, and a large number of high-energy electrons are generated through the streamer. The high-energy electrons react with gases surrounding the high-energy electrons due to electron collision. As a result, a large amount of ozone and a large number of hydroxyl radicals and negative ions are generated.

The generated ozone, hydroxyl radicals, and negative ions oxidize and decompose pollutants, such as noxious gases contained in air, to clean the air.

As described above, the conventional surface discharge type air cleaning device performs discharge through the entire surface of the insulating dielectric body 10, and therefore, the onset voltage of the conventional surface discharge type air cleaning device is lower than that of a corona discharge type air cleaning device. Consequently, power consumption is low, and noise generated from the conventional surface discharge type air cleaning device is small, and therefore, air is efficiently cleaned by the conventional surface discharge type air cleaning device even when the conventional surface discharge type air cleaning device is used in a small space.

In the conventional surface discharge type air cleaning device, however, the discharge electrode 12 is disposed on the upper surface of the insulating dielectric body 10, i.e., the pattern of the discharge electrode 12 is formed on the upper surface of the insulating dielectric body 10 in an embossed structure. As a result, there is a limit in lowering the onset voltage and input energy necessary to cause discharge. Consequently, the number of hydroxyl radicals and negative ions, which are generated when the voltage is low, is decreased, and the amount of ozone, which is toxic to humans, is increased. In addition, power consumption is increased.

Specifically, electrical charge concentration is increased at the end part E of the discharge electrode 12, as shown in FIG. 3. Consequently, it is required that the onset voltage and the input energy be raised in order to accomplish uniform generation distribution of streamer throughout the entire region of the dielectric body. Especially, thermal stress is partially increased at the end part E of the discharge electrode 12, and therefore, gases surrounding the discharge electrode 12 are heated. As a result, the amount of ozone generated is increased. On the other hand, the number of hydroxyl radicals and negative ions is decreased. Also, partial deterioration of the electrode occurs rapidly due to partial increase of thermal stress, and therefore, the service life of the surface discharge type air cleaning device is shortened, and discharge safety is also lowered. Consequently, air cleaning efficiency is decreased.

Furthermore, the insulating dielectric body 10 of the conventional surface discharge type air cleaning device is composed of two sheets, between which the ground electrode 14 is disposed. Consequently, the structure of the conventional surface discharge type air cleaning device is complicated, and therefore, manufacturing costs of the conventional surface discharge type air cleaning device are increased.

SUMMARY OF THE INVENTION

Therefore, the present invention has been made in view of the above problems, and it is an object of the present invention to provide a discharge device that is capable of increasing generation of hydroxyl radicals while decreasing generation of ozone, which is toxic to humans, thereby increasing discharge safety and improving noxious gas sterilizing efficiency and air cleaning efficiency.

In accordance with one aspect of the present invention, the above and other objects can be accomplished by the provision of a discharge device comprising: an insulating dielectric body, a discharge electrode having an electrode forming part of a predetermined area formed on a surface of the insulating dielectric body and at least one non-electrode forming part disposed in the electrode forming part; and a ground electrode formed at an opposite surface of the insulating dielectric body to the surface at which the discharge electrode is formed, wherein the discharge electrode and the ground electrode have a plurality of pointed ends protruded therefrom, respectively, such that the pointed ends of the discharge electrode and the pointed ends of the ground electrode are protruded in an opposite direction to each other.

Preferably, the discharge electrode has a pattern part of a predetermined area formed on the upper surface of the insulating dielectric body and at least one non-pattern part disposed in the pattern part, the electrode being not formed at the at least one non-pattern part, and a ground electrode is formed at the lower surface of the insulating dielectric body, wherein the discharge electrode and the ground electrode have a plurality of pointed ends protruded therefrom, respectively, and the pointed ends of the discharge electrode and the pointed ends of the ground electrode are disposed at the upper and lower surfaces of the insulating dielectric body, respectively, such that the pointed ends of the discharge electrode and the pointed ends of the ground electrode correspond to each other.

Preferably, the pointed ends of the discharge electrode are protruded into the at least one non-pattern part of the discharge electrode.

Preferably, the at least one non-pattern part of the discharge electrode is formed in the shape of a rectangle, and the pointed ends of the discharge electrode are protruded from opposite sides of the least one non-pattern part of the discharge electrode.

Preferably, each of the pointed ends of the discharge electrode is formed in the shape of a triangle.

Preferably, the ground electrode extends a predetermined length in the longitudinal direction of the at least one non-pattern part of the discharge electrode such that the ground electrode corresponds to the at least one non-pattern part of the discharge electrode, and the pointed ends are protruded from opposite sides of the ground electrode.

Preferably, each of the pointed ends of the ground electrode is formed in the shape of a rectangle.

Preferably, the pointed ends of the discharge electrode and the pointed ends of the ground electrode are disposed such that the pointed ends of the discharge electrode and the pointed ends of the ground electrode partially overlap with each other on the same plane.

Preferably, the at least one non-pattern part of the discharge electrode comprises a plurality of non-pattern parts, and the ground electrode is formed in a multiple-row structure such that the ground electrode corresponds to the non-pattern parts.

In accordance with another aspect of the present invention, there is provided a surface discharge type air cleaning device comprising: an insulating dielectric body formed in the shape of a sheet; a discharge electrode formed on the upper surface of the insulating dielectric body; and a ground electrode formed at the lower surface of the insulating dielectric body, wherein the discharge electrode and the ground electrode have a plurality of pointed ends protruded therefrom, respectively.

Preferably, the pointed ends of the discharge electrode and the pointed ends of the ground electrode are disposed at the upper and lower surfaces of the insulating dielectric body, respectively, such that the pointed ends of the discharge electrode and the pointed ends of the ground electrode correspond to each other.

According to the present invention, the voltage applied to generate plasma can be lowered. Consequently, the generated number of negative ions and hydroxyl radicals is increased while the generated amount of ozone, which is toxic to humans, is decreased, and therefore, air cleaning efficiency is improved.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 4:
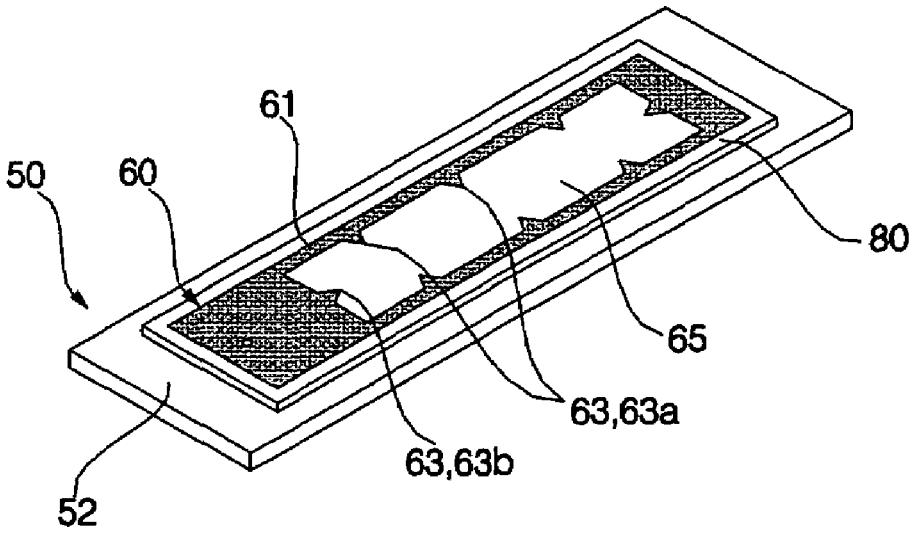
FIG. 4 is a perspective view of a surface discharge type air cleaning device according to a first preferred embodiment of the present invention showing the upper surface of the surface discharge type air cleaning device.
Figure 5:
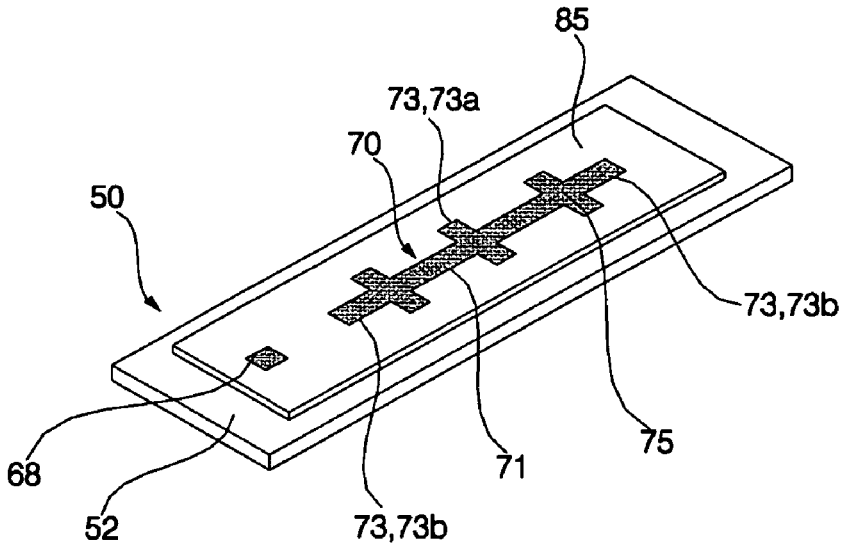
FIG. 5 is a perspective view of the surface discharge type air cleaning device according to the first preferred embodiment of the present invention showing the lower surface of the surface discharge type air cleaning device.
Figure 6:
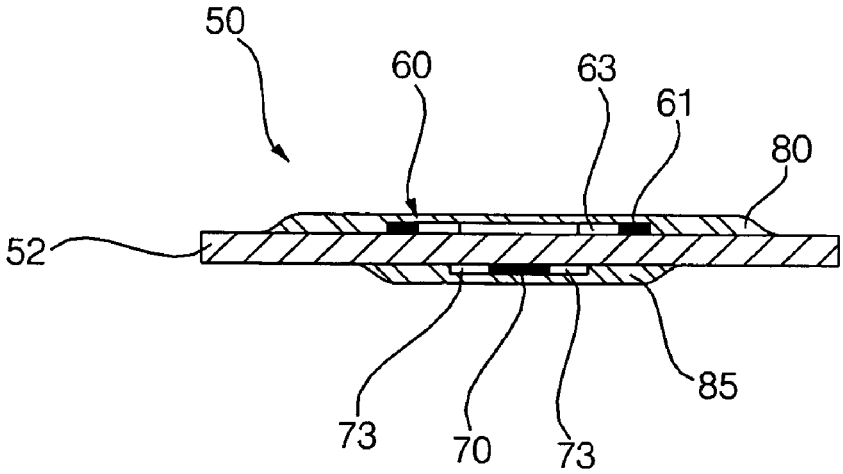
FIG. 6 is a cross-sectional view of the surface discharge type air cleaning device according to the first preferred embodiment of the present invention.

A discharge device 50 according to a first preferred embodiment of the present invention is shown in FIGS. 4 to 6. FIG. 4 is a perspective view of the surface discharge type air cleaning device 50 according to the first preferred embodiment of the present invention showing the upper surface of the surface discharge type air cleaning device 50, FIG. 5 is a perspective view of the surface discharge type air cleaning device 50 according to the first preferred embodiment of the present invention showing the lower surface of the surface discharge type air cleaning device 50, and FIG. 6 is a cross-sectional view of the surface discharge type air cleaning device 50 according to the first preferred embodiment of the present invention.

As shown in FIGS. 4 to 6, the discharge device 50 according to the first preferred embodiment of the present invention comprises: an insulating dielectric body 52 a discharge electrode 60 having an electrode forming part of a predetermined area formed on a surface of the insulating dielectric body 52 and at least one non-electrode forming part disposed in the electrode forming part; and a ground electrode 70 formed at an opposite surface of the insulating dielectric body to the surface at which the discharge electrode 60 is formed, wherein the discharge electrode and the ground electrode have a plurality of pointed ends protruded therefrom, respectively, such that the pointed ends of the discharge electrode and the pointed ends of the ground electrode are protruded in an opposite direction to each other.

Said discharge electrode 60 is formed at the upper surface of the insulating dielectric body 52, and the ground electrode 70 is formed at the lower surface of the insulating dielectric body 52. The discharge electrode 60 and the ground electrode 70 are protected by protective films 80 and 85 coated on the upper and lower surfaces of the insulating dielectric body 52.

The insulating dielectric body 52 is composed of a single rectangular sheet having a predetermined thickness, which is distinguished from the insulating dielectric body of the conventional surface discharge type air cleaning device as described above. Preferably, the insulating dielectric body 52 is made of a resin material having high oxidization resistance for organic matter or a ceramic material for inorganic matter. However, the material of the insulating dielectric body 52 is not limited to the resin material or the ceramic material, and the shape of the insulating dielectric body 52 is not limited to the rectangular shape. The insulating dielectric body 52 may be formed of various materials and shapes according to the design conditions of the insulating dielectric body 52.

The discharge electrode 60 is formed of a pattern of a conductive metallic material printed on the upper surface of the insulating dielectric body 52. The pattern is formed in a rectangular closed structure having a predetermined area.

Figure 1:
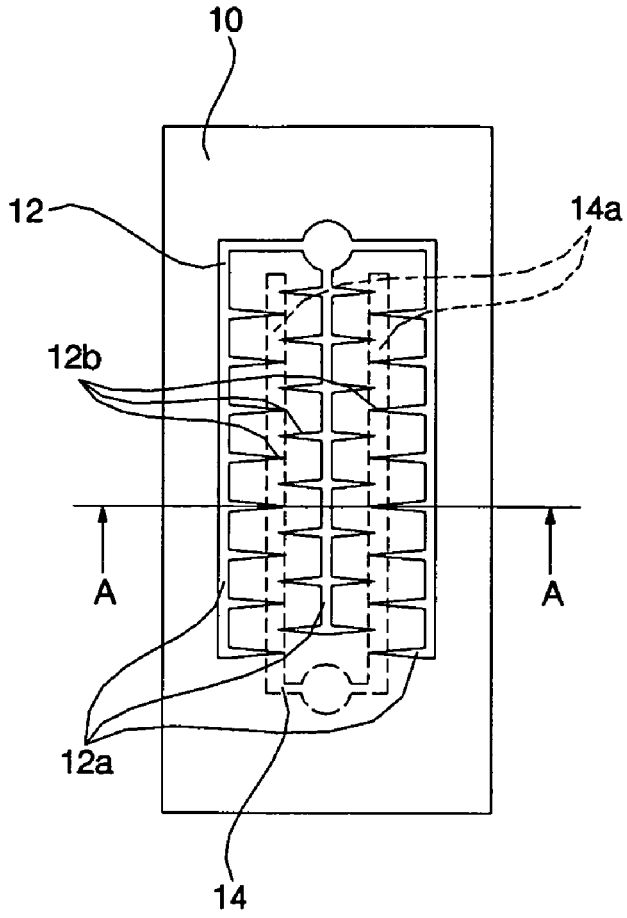
FIG. 1 (Prior Art)
FIG. 1 is a plan view showing a conventional surface discharge type air cleaning device.
Figure 2:
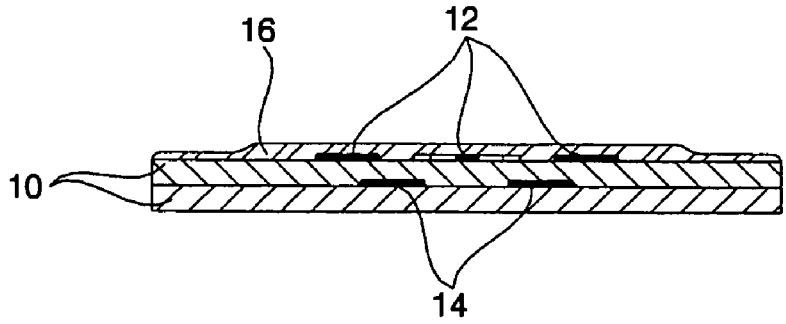
FIG. 2 (Prior Art)
FIG. 2 is a cross-sectional view of the conventional surface discharge type air cleaning device seen from line A-A of FIG. 1.
Figure 3:
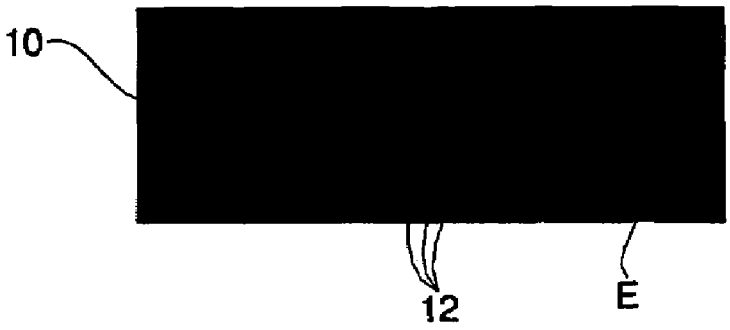
FIG. 3 is a reference view illustrating plasma discharge of the conventional surface discharge type air cleaning device.

It should be noted that the discharge electrode 60 is formed in a depressed structure, which is distinguished from the embossed structure of the discharge electrode 60 of the conventional surface discharge type air cleaning device as shown in FIG. 1. In the depressed structure, relatively low input energy can be used.

Specifically, the discharge electrode 60 has a non-pattern part 65 disposed in a part 61 where the pattern is formed (hereinafter, referred to as a "pattern part"). The electrode is not formed at the non-pattern part 65. The non-pattern part 65 extends in the longitudinal direction of the pattern of the discharge electrode 60. Consequently, the non-pattern part 65 is formed in a closed structure surrounded by the pattern part 61.

Especially in the non-pattern part 65 are formed a plurality of pointed ends 63, which are protruded from the pattern part 61.

When the non-pattern part 65 is formed in the shape of a rectangle, as shown in FIG. 4, the pointed ends 63 comprise: long-side pointed ends 63*a*, which are protruded from the long sides of the non-pattern part 65 while being opposite to each other, and short-side pointed ends 63*b*, which are protruded from the short sides of the non-pattern part 65 while being opposite to each other.

In the illustrated embodiment, each of the pointed ends 63 is formed in the shape of a triangle, although each of the pointed ends 63 may be formed in the shape of a rectangle or a circle according to the design conditions.

In the illustrated embodiment, a plurality of pointed ends 63 are disposed at each of the long sides of the non-pattern part 65, and a single pointed end 63 is disposed at each of the short sides of the non-pattern part 65. However, the number of the pointed ends 63 may be changed without limits according to the design conditions. Of course, the short-side pointed ends 63*b* may be omitted.

Preferably, the pointed ends 63 are disposed at a predetermined interval or in a symmetrical structure such that plasma is uniformly generated at the entire area.

The ground electrode 70 is formed of a pattern of a conductive metallic material printed on the lower surface of the insulating dielectric body 52 in the same fashion as the discharge electrode 60.

The ground electrode 70 extends a predetermined length in the longitudinal direction of the non-pattern part 65 of the discharge electrode 60 such that the ground electrode 70 corresponds to the non-pattern part 65 of the discharge electrode 60.

At the ground electrode 70 are also formed a plurality of pointed ends 73, which correspond to the pointed ends 63 of the discharge electrode 60. The pointed ends 73 comprise: side protrusions 73*a* protruded from opposite sides of a main electrode part 71, which extends a predetermined length in a linear structure; and end protrusions 73*b* protruded from opposite ends of the main electrode part 71.

In the illustrated embodiment, each of the pointed ends 73 of the ground electrode 70 is formed in the shape of a rectangle, although each of the pointed ends 73 of the ground electrode 70 may be formed in the shape of a triangle, a circle, or a polygon according to the design conditions.

The pointed ends 63 of the discharge electrode 60 and the pointed ends 73 of the ground electrode 70 are disposed such that the pointed ends 63 and 73 partially overlap with each other on the same plane.

The protective films 80 and 85 are made of a non-conductive material. Preferably, the protective films 80 and 85 are made of a material that is not easily deteriorated, and thus, not damaged when plasma is discharged through the entire surface of the insulating dielectric body 52. The protective films 80 and 85 are formed in the shape of rectangles having sizes greater than those of the discharge electrode 60 and the ground electrode 70, respectively. The protective films 80 and 85 are applied to the upper and lower surfaces of the insulating dielectric body 52, respectively.

The protective films 80 and 85 have partially-opened structures such that the discharge electrode 60 and the ground electrode 70 are provided with terminal parts 68 and 75, which are connected to an external circuit, respectively.

The terminal part 68 of the discharge electrode 60 extends from the upper surface to the lower surface of the insulating dielectric body 52 such that the terminal part 68 of the discharge electrode 60 can be connected to the external circuit at the lower surface of the insulating dielectric body 52, as shown in FIGS. 4 and 5.

Now, the operation of the surface discharge type air cleansing device 50 with the above-stated construction according to the first preferred embodiment of the present invention will be described.

Figure 7:
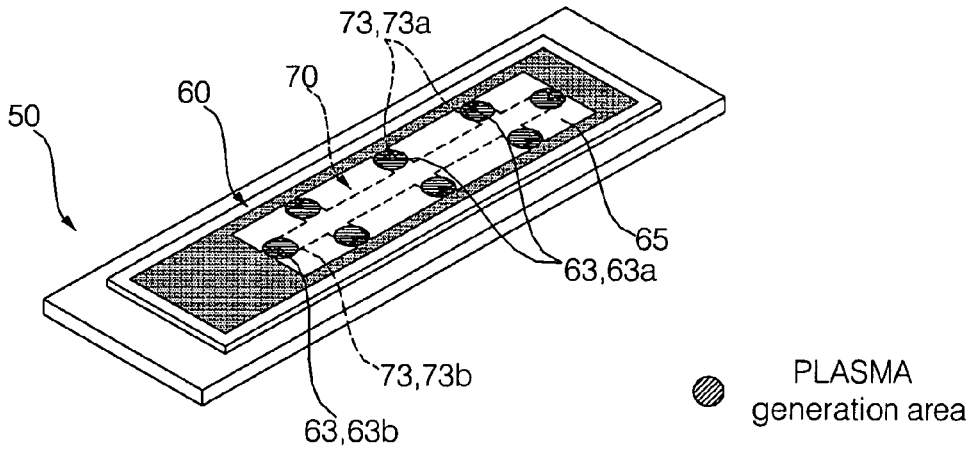
FIG. 7 is a reference view illustrating plasma discharge of the surface discharge type air cleaning device according to the first preferred embodiment of the present invention.

FIG. 7 is a reference view illustrating plasma discharge of the surface discharge type air cleaning device according to the first preferred embodiment of the present invention.

The discharge electrode 60 has the pattern part 61, which is formed in the depressed structure. Consequently, electrical charges are uniformly distributed at the non-pattern part 65 of the discharge electrode 60, and therefore, stable plasma formation is possible.

Especially, electrical charges are concentrated at the pointed ends 63 and 73, which are disposed at the upper and lower surfaces of the insulating dielectric body 52 at the predetermined interval, respectively, while the pointed ends 63 and 73 correspond to each other, when high voltage is applied to the surface discharge type air cleaning device. As a result, discharge is smoothly accomplished at the corresponding pointed ends 63 and 73.

Specifically, electrical charges are concentrated at the pointed ends 63 during the plasma discharge. According to the present invention, the pointed ends 63 are formed in large number at the predetermined interval in the non-pattern part 65. Consequently, voltage applied to generate plasma is lowered, and therefore, stable plasma formation is possible. Furthermore, the pointed ends 73 are formed at the ground electrode 70, and the pointed ends 73 of the ground electrode 70 partially overlap with the pointed ends 63 of the discharge electrode 60. As a result, plasma discharge is accomplished at low voltage. Consequently, supply of voltage lower than oxygen dissociation energy is possible, and therefore, the generated amount of ozone is minimized. On the other hand, a large number of hydroxyl radicals and negative ions are generated at the low voltage.

Also, the plasma discharge areas around the respective pointed ends 63 and 73 are changed, as shown in FIG. 7, depending on the magnitude of applied voltage.

Consequently, the surface discharge type air cleaning device 50 according to the first preferred embodiment of the present invention is capable of using negative ions and hydroxyl radicals, which are generated at low voltage by virtue of the corresponding pointed ends 63 and 73 of the discharged electrode 60 and the ground electrode 70, to increase noxious gas sterilizing efficiency and air cleaning efficiency. Also, the surface discharge type air cleaning device 50 according to the first preferred embodiment of the present invention is capable of controlling the magnitude of applied voltage to easily control the generated amount of plasma, which is generated at the respective pointed ends 63 and 73. Consequently, the surface discharge type air cleaning device 50 according to the first preferred embodiment of the present invention can be appropriately controlled and used based on air cleaning conditions.

Figure 8:
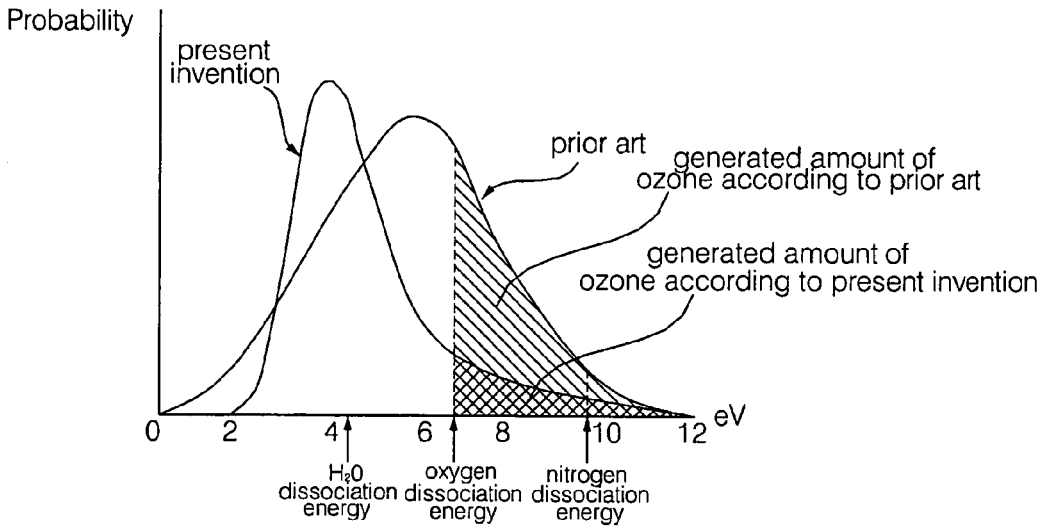
FIG. 8 is a graph illustrating comparison in gaseous energy probability distribution based on applied voltage between the surface discharge type air cleaning device according to the first preferred embodiment of the present invention and the conventional surface discharge type air cleaning device.

FIG. 8 is a graph illustrating comparison in gaseous energy probability distribution based on applied voltage between the surface discharge type air cleaning device 50 according to the first preferred embodiment of the present invention and the conventional surface discharge type air cleaning device. As can be seen from FIG. 8, the discharge electrode is formed in the depressed structure, and therefore, the surface discharge type air cleaning device 50 can accomplish discharge at lower voltage than the conventional surface discharge type air cleaning device. Consequently, supply of voltage lower than oxygen dissociation energy is possible, and therefore, the generated amount of ozone is minimized. On the other hand, a large number of hydroxyl radicals and negative ions are generated at the low voltage, and therefore, oxidization and decomposition of noxious gases are smoothly carried out.

In conclusion, the surface discharge type air cleaning device 50 according to the first preferred embodiment of the present invention is capable of lowering onset voltage and input energy by the provision of the depressed pattern structure of the non-pattern part 65 and the corresponding pointed ends of the discharge electrode and the ground electrode. As a result, the generated number of hydroxyl radicals and negative ions is increased while the generated amount of ozone, which is toxic to humans, is decreased. Consequently, sterilization and purification of indoor air are carried out using the hydroxyl radicals and the negative ions. Furthermore, partial increase of thermal stress is effectively prevented, and therefore, the service life of the surface discharge type air cleaning device is increased, and discharge safety is improved.

Figure 9:
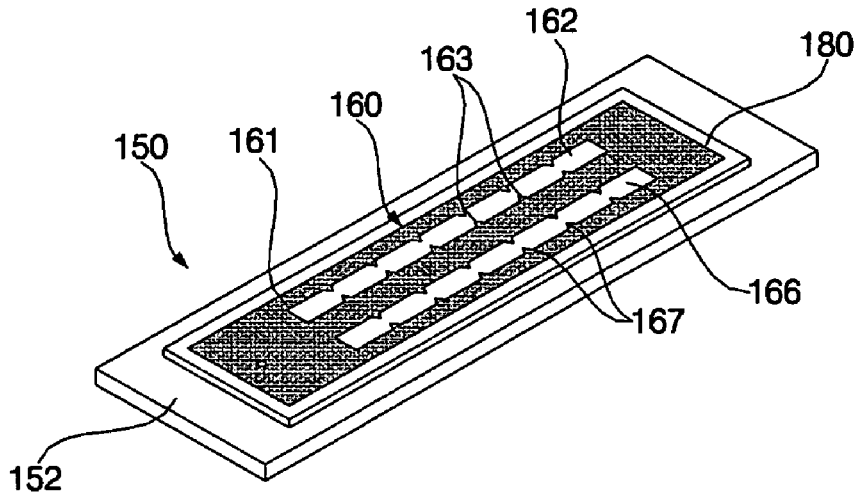
FIG. 9 is a perspective view of a surface discharge type air cleaning device according to a second preferred embodiment of the present invention showing the upper surface of the surface discharge type air cleaning device.
Figure 10:
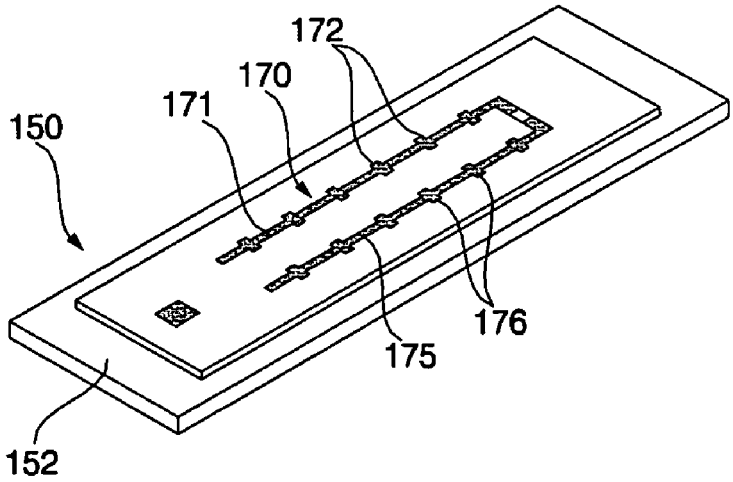
FIG. 10 is a perspective view of the surface discharge type air cleaning device according to the second preferred embodiment of the present invention showing the lower surface of the surface discharge type air cleaning device.
Figure 11:
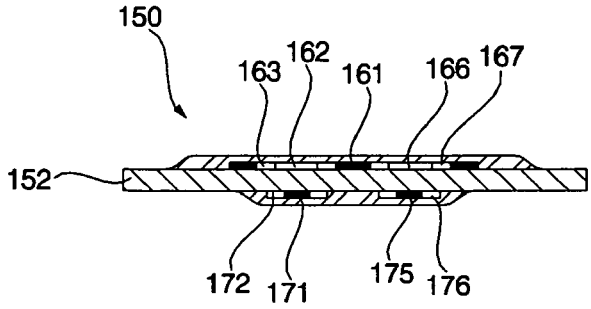
FIG. 11 is a cross-sectional view of the surface discharge type air cleaning device according to the second preferred embodiment of the present invention.

A surface discharge type air cleaning device 150 according to a second preferred embodiment of the present invention is shown in FIGS. 9 and 11. FIG. 9 is a perspective view of the surface discharge type air cleaning device 150 according to the second preferred embodiment of the present invention showing the upper surface of the surface discharge type air cleaning device, FIG. 10 is a perspective view of the surface discharge type air cleaning device 150 according to the second preferred embodiment of the present invention showing the lower surface of the surface discharge type air cleaning device, and FIG. 11 is a cross-sectional view of the surface discharge type air cleaning device 150 according to the second preferred embodiment of the present invention.

As shown in FIGS. 9 and 11, the surface discharge type air cleaning device 150 according to the second preferred embodiment of the present invention is different from the surface discharge type air cleaning device 50 according to the first preferred embodiment of the present invention in that a discharge electrode 160 has a pair of non-pattern parts 162 and 166, and a ground electrode 170 also has a pair of main electrode parts 171 and 175, which correspond to the non-pattern parts 162 and 166, respectively.

As shown in FIG. 9, the discharge electrode 160, which is disposed at the upper surface of an insulating dielectric body 152, has a patent part 161, in which the non-pattern parts 162 and 166 are formed while being disposed in parallel with each other. In the non-pattern parts 162 and 166 are formed pointed ends 163 and 167, respectively, which are opposite to each other.

As shown in FIG. 10, the ground electrode 170 is disposed at the lower surface of the insulating dielectric body 152, and the main electrode parts 171 and 175 are arranged in parallel with each other and are connected to each other such that the ground electrode 170 is formed in the shape of a "]". The main electrode parts 171 and 175 have pointed ends 172 and 176, respectively, which are protruded from opposite sides of the main electrode parts 171 and 175 such that the pointed ends 172 and 176 of the ground electrode 170 correspond to the pointed ends 163 and 167 of the discharge electrode 160, respectively.

In the illustrated embodiment, the electrodes 160 and 170 are arranged in a two-row structure, and the pointed ends 172 and 176 of the ground electrode 170 correspond to the pointed ends 163 and 167 of the discharge electrode 160, respectively. However, the discharge electrode 160 may have three or more non-pattern parts according to the size of the insulating dielectric body 152 and its use conditions. Also, the ground electrode 170 may have three or more main electrode parts, which are arranged in parallel with one another, such that the three or more main electrode parts of the ground electrode 170 correspond to the three or more non-pattern parts of the discharge electrode 160, respectively.

Figure 12:
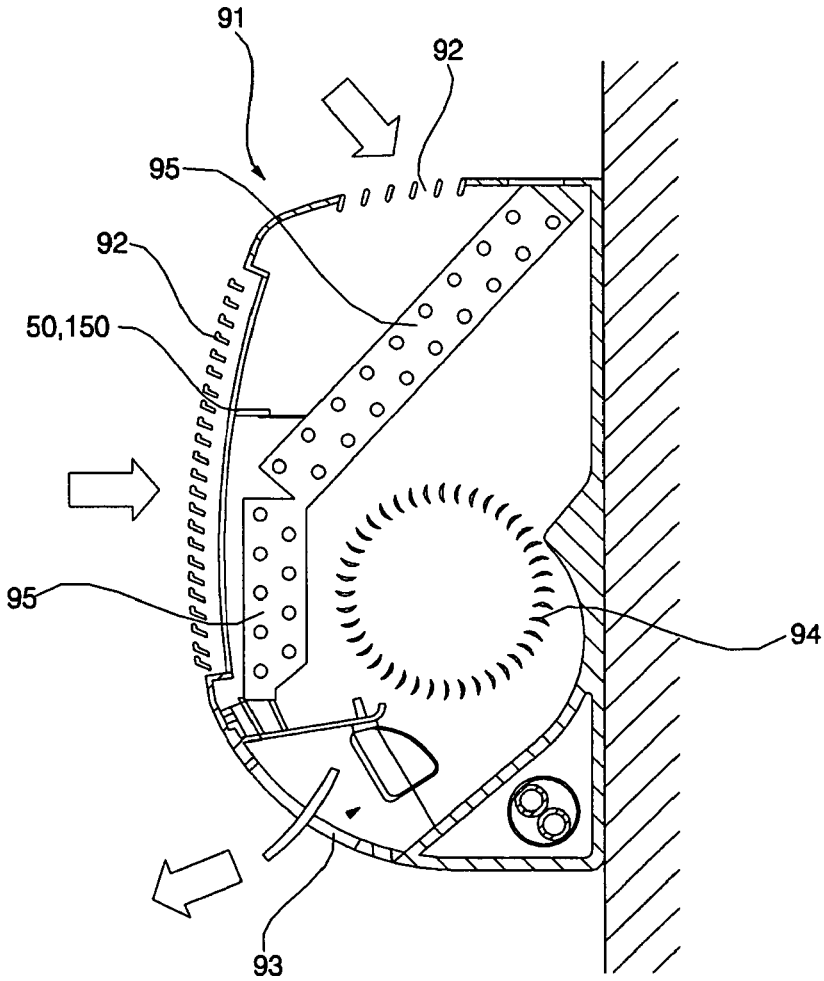
FIG. 12 is a longitudinal sectional view showing an indoor unit of an air conditioner, to which the surface discharge type air cleaning device according to the present invention is applied.

FIG. 12 is a longitudinal sectional view showing an indoor unit 91 of an air conditioner, to which the surface discharge type air cleaning device 50 or 150 according to the present invention is applied.

Generally, the indoor unit 91 of the air conditioner is provided with an inlet port 92 and an outlet port 93, through which indoor air is circulated. In the indoor unit 91 are mounted a blower 94 for forcibly circulating air and a heat exchanger 95 for performing heat exchange with air passing through the heat exchanger 95.

The surface discharge type air cleaning device 50 or 150 according to the first preferred embodiment of the present invention may be disposed at any position on an air channel in the indoor unit. Preferably, the surface discharge type air cleaning device 50 or 150 is disposed inside the inlet port 92, as shown in FIG. 12. The surface discharge type air cleaning device 50 or 150 is formed in the shape of a sheet, and therefore, the surface discharge type air cleaning device 50 or 150 is preferably disposed in parallel with the air flow direction such that flow resistance is minimized.

In the drawing, only one surface discharge type air cleaning device 50 or 150 is mounted in the indoor unit 91, although several surface discharge type air cleaning devices may be mounted in the indoor unit 91 if necessary.

The operation of the surface discharge type air cleaning device 50 or 150 according to the present invention will be described hereinafter under the condition that the surface discharge type air cleaning device 50 or 50 is mounted in the indoor unit 91 as described above.

When the air conditioner is turned on to operate the blower 94, indoor air is introduced into the indoor unit 91 through the inlet port 92 and passes through the heat exchanger 95. As a result, the air is cooled, and is then discharged into the interior of a room where the indoor unit 91 is installed through the outlet port 93. When power source is applied to the surface discharge type air cleaning device 50 or 150 to clean the indoor air, some of the air introduced into the indoor unit 91 through the inlet port 92 passes by the surface discharge type air cleaning device 50 or 150. As a result, pollutants are sterilized or decomposed, and therefore, the air is cleaned.

Referring to FIGS. 4 to 11, when the air conditioner is operated, and the power source having voltage greater than onset voltage is applied to the discharge electrode 60 and the ground electrode 70, a dielectric breakdown phenomenon occurs between the discharge electrode 60 and the ground electrode 70, and a plasma discharge area is formed in the vicinity of the pointed ends 63 on the surface of the insulating dielectric body 52. At this time, a streamer is formed on the surface of the insulating dielectric body 52. As a result, a large number of high-energy electrons are generated through the streamer, and the high-energy electrons react with gases surrounding the high-energy electrons due to electron collision. Consequently, a small amount of ozone and a large number of hydroxyl radicals and negative ions are generated.

The generated ozone, the amount of which is small, and the generated hydroxyl radicals and negative ions, the number of which is large, oxidize and decompose pollutants, such as noxious gases, contained in the indoor air, to clean the air.

In the above description, the surface discharge type air cleaning device 50 according to the present invention is applied to the indoor unit of the air conditioner, although the surface discharge type air cleaning device 50 may be applied to all kinds of equipment, such as various air purifiers or noxious gas purifying apparatuses.

As apparent from the above description, the surface discharge type air cleaning device according to the present invention has the following effects.

The pattern of the discharge electrode is formed in the depressed structure. Consequently, it is possible to lower onset voltage and input energy and to accomplish entirely uniform and stable plasma formation, and therefore, the generated number of hydroxyl radicals and negative ions, which sterilize and decompose noxious gases, is increased while the generated amount of ozone, which is toxic to humans, is decreased, and power consumption is reduced.

Since entirely uniform and stable plasma formation is accomplished at the non-pattern part, decrease of the service life of the surface discharge type air cleaning device due to partial deterioration of the discharge electrode is prevented, and discharge safety is increased. Consequently, air cleaning efficiency is improved.

Furthermore, the discharge electrode and the ground electrode are formed on the upper and lower surfaces of the insulating dielectric body, which is composed of a single sheet. Consequently, the structure of the surface discharge type air cleaning device is simplified, and manufacturing costs of the surface discharge type air cleaning device are reduced.

Especially, the pointed ends of the discharge electrode correspond to the pointed ends of the ground electrode, respectively, and therefore, the voltage applied to generate plasma can be lowered. Consequently, the generated number of negative ions and hydroxyl radicals is increased while the generated amount of ozone, which is toxic to humans, is decreased, and therefore, air cleaning efficiency is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A discharge device generating discharge phenomena, comprising:

a single insulating dielectric body;

a discharge electrode having an electrode forming part of a predetermined area on a surface of the insulating dielectric body and at least one non-electrode forming part disposed in the electrode forming part; and a ground electrode formed at an opposite surface of the insulating dielectric body to the surface at which the discharge electrode is formed, wherein the discharge electrode and the ground electrode have a plurality of pointed ends protruded therefrom, respectively, such that the pointed ends of the discharge electrode and the pointed ends of the ground electrode are protruded in an opposite direction to each other, a protective film is coated on each of an upper surface and a lower surface of the insulating dielectric body to protect the discharge electrode and the ground electrode, the electrode forming part is a pattern part of a predetermined area formed on the upper surface of the single insulating dielectric body, and the non-electrode forming part is a non-pattern part disposed in the pattern part, and the ground electrode extends a predetermined length in the longitudinal direction at a place on which the non-pattern part of the discharge electrode is reflected when the discharge electrode is projected in the perpendicular direction to the surface of the single insulating dielectric body at which the ground electrode is formed.

2. The discharge device as set forth in claim 1, wherein the pointed ends of the discharge electrode are protruded into the at least one non-pattern part of the discharge electrode.

3. The discharge device as set forth in claim 2, wherein the at least one non-pattern part of the discharge electrode is formed in the shape of a rectangle, and the pointed ends of the discharge electrode are protruded from opposite sides of the least one non-pattern part of the discharge electrode.

4. The discharge device as set forth in claim 2, wherein each of the pointed ends of the discharge electrode is formed in the shape of a triangle.

5. The discharge device as set forth in claim 1, wherein the pointed ends are protruded from opposite sides of the ground electrode.

6. The discharge device as set forth in claim 1, wherein the pointed ends of the discharge electrode and the pointed ends of the ground electrode are disposed such that the pointed ends of the discharge electrode and the pointed ends of the ground electrode partially overlap with each other on the same plane.

7. The discharge device as set forth in claim 1, wherein the at least one non-pattern part of the discharge electrode comprises a plurality of non-pattern parts.

8. The discharge device as set forth in claim 7, wherein the ground electrode is formed in a multiple-row structure such that the ground electrode corresponds to the non-pattern parts.

9. A discharge device comprising:

a single insulating dielectric body formed in the shape of a sheet;

a discharge electrode formed on an upper surface of the single insulating dielectric body; and a ground electrode formed at a lower surface of the single insulating dielectric body, wherein the discharge electrode and the ground electrode have a plurality of pointed ends protruded therefrom, respectively, a protective film is coated on each of an upper surface and a lower surface of the single insulating dielectric body to protect the discharge electrode and the ground electrode, the electrode forming part is a pattern part of a predetermined area formed on the upper surface of the single insulating dielectric body, and the non-electrode forming part is a non-pattern part disposed in the pattern part, and the ground electrode extends a predetermined length in the longitudinal direction at a place on which the non-pattern part of the discharge electrode is reflected when the discharge electrode is projected in the perpendicular direction to the surface of the single insulating dielectric body at which the ground electrode is formed.

10. The discharge device as set forth in claim 9, wherein the pointed ends of the discharge electrode and the pointed ends of the ground electrode are disposed at the upper and lower surfaces of the insulating dielectric body, respectively, such that the pointed ends of the discharge electrode and the pointed ends of the ground electrode correspond to each other.

11. The discharge device as set forth in claim 9, wherein each of the pointed ends of the discharge electrode is formed in the shape of a triangle.

12. The discharge device as set forth in claim 9, wherein each of the pointed ends of the ground electrode is formed in the shape of a rectangle.

13. The discharge device as set forth in claim 9, wherein the pointed ends of the discharge electrode and the pointed ends of the ground electrode are disposed such that the pointed ends of the discharge electrode and the pointed ends of the ground electrode partially overlap with each other on the same plane.

14. The discharge device as set forth in claim 9, wherein the discharge electrode has a pattern part of a predetermined area and at least one non-pattern part disposed in the pattern part, the electrode being not formed at the at least one non-pattern part, and the at least one non-pattern part comprises a plurality of non-pattern parts.

15. The discharge device as set forth in claim 14, wherein the ground electrode is formed in a multiple-row structure such that the ground electrode corresponds to the non-pattern parts.

16. A discharge device comprising:

an insulating dielectric body formed in a shape of a sheet;

a discharge electrode having a pattern part of a predetermined area formed on an upper surface of the insulating dielectric body and at least one non-pattern part disposed in the pattern part, the electrode being not formed at the at least one non-pattern part; and a ground electrode formed at a lower surface of the insulating dielectric body, wherein the discharge electrode has a plurality of pointed ends protruded into the at least one non-pattern part of the discharge electrode, the ground electrode extends a predetermined length in the longitudinal direction place on which the non-pattern part of the discharge electrode is reflected when the discharge electrode is projected in the perpendicular direction to the surface of the insulating dielectric body at which the around electrode is formed, the pointed ends being protruded from opposite sides of the ground electrode, and the pointed ends of the discharge electrode and the pointed ends of the ground electrode are disposed at the upper and lower surfaces of the insulating dielectric body, respectively, such that the pointed ends of the discharge electrode and the pointed ends of the ground electrode correspond to each other, wherein a protective film is coated on each of an upper surface and a lower surface of the insulating dielectric body to protect the discharge electrode and the ground electrode.

17. The discharge device as set forth in claim 16, wherein the pointed ends of the discharge electrode and the pointed ends of the ground electrode are disposed such that the pointed ends of the discharge electrode and the pointed ends of the ground electrode partially overlap with each other on the same plane.

18. The discharge device as set forth in claim 16, wherein the at least one non-pattern part of the discharge electrode comprises a plurality of non-pattern parts.

19. The discharge device as set forth in claim 18, wherein the ground electrode is formed in a multiple-row structure such that the ground electrode corresponds to the non-pattern parts.

20. An air conditioner having a discharge device generating discharge phenomena, the discharge device comprising:

an insulating dielectric body;

a discharge electrode having an electrode forming part of a predetermined area on a surface of the insulating dielectric body and at least one non-electrode forming part disposed in the electrode forming part ; and a ground electrode formed at an opposite surface of the insulating dielectric body to the surface at which the discharge electrode is formed, wherein the discharge electrode and the ground electrode have a plurality of pointed ends protruded therefrom, respectively, such that the pointed ends of the discharge electrode and the pointed ends of the ground electrode are protruded in a opposite direction and a shape corresponding to each other, a protective film is coated on each of the upper surface and the lower surface of the insulating dielectric body to protect the discharge electrode and the ground electrode, the electrode forming part is a pattern part of a predetermined area formed on the upper surface of the insulating dielectric body, and the non-electrode forming part is a non-pattern part disposed in the pattern part, and the ground electrode extends a predetermined length in the longitudinal direction at a place on which the non-pattern part of the discharge electrode is reflected when the discharge electrode is projected in the perpendicular direction to the surface of the insulating dielectric body at which the ground electrode is formed.

21. The air conditioner of claim 20, wherein the insulating dielectric body of the discharge device includes only a singe insulating dielectric body.

22. A discharge device generating discharge phenomena, comprising:

a single insulating dielectric body;

a discharge electrode having an electrode forming part of a predetermined area on a surface of the single insulating dielectric body and at least one non-electrode forming part disposed in the electrode forming part; and a ground electrode formed at an opposite surface of the single insulating dielectric body to the surface at which the discharge electrode is formed, wherein a protective film is coated on each of an upper surface and a lower surface of the single insulating dielectric body to protect the discharge electrode and the ground electrode, the electrode forming part is a pattern part of a predetermined area formed on the upper surface of the single insulating dielectric body, and the non-electrode forming part is a non-pattern part disposed in the pattern part, and the ground electrode extends a predetermined length in the longitudinal direction at a place on which the non-pattern part of the discharge electrode is reflected when the discharge electrode is projected in the perpendicular direction to the surface of the single insulating dielectric body at which the ground electrode is formed.

* * * * *